US007500921B2

(12) United States Patent
Cheng

(10) Patent No.: US 7,500,921 B2
(45) Date of Patent: Mar. 10, 2009

(54) GOLF CLUB SHAFT INSERT ASSEMBLY

(76) Inventor: Michael H. L. Cheng, 5369 Evening Sky Dr., Simi Valley, CA (US) 93063

( * ) Notice: Subject to any disclaimer, the term of this patent is extended or adjusted under 35 U.S.C. 154(b) by 0 days.

(21) Appl. No.: 11/279,677

(22) Filed: Apr. 13, 2006

(65) Prior Publication Data

US 2007/0243947 A1 Oct. 18, 2007

(51) Int. Cl.
*A63B 53/16* (2006.01)

(52) U.S. Cl. ..... 473/318

(58) Field of Classification Search ..... 473/316–323, 473/296–299, 523; 403/109.1, 109.3, 109.4, 403/109.5, 109.6, 109.9; 411/34–38
See application file for complete search history.

(56) References Cited

U.S. PATENT DOCUMENTS

| | | | | |
|---|---|---|---|---|
| 2,133,696 | A | 10/1938 | Hall | |
| 2,508,039 | A | 5/1950 | Neuwirth | |
| 2,999,706 | A * | 9/1961 | Wilcox | 403/370 |
| 3,773,375 | A | 11/1973 | Nehls | |
| 3,833,223 | A | 9/1974 | Shulkin | |
| 4,214,395 | A | 7/1980 | Caldwell, Jr. | |
| 4,319,750 | A | 3/1982 | Roy | |
| 4,561,922 | A | 12/1985 | Peerman et al. | |
| 4,738,046 | A | 4/1988 | Fraylick et al. | |
| 4,826,168 | A * | 5/1989 | McGuire et al. | 473/295 |
| 4,893,519 | A | 1/1990 | Corso et al. | |
| 5,054,781 | A | 10/1991 | Soong | |
| 5,080,363 | A | 1/1992 | Soong | |
| 5,205,552 | A * | 4/1993 | Green, Jr. | 473/312 |
| 5,267,733 | A * | 12/1993 | Szokola | 473/313 |
| 5,324,032 | A * | 6/1994 | Minami | 473/320 |
| 5,588,920 | A | 12/1996 | Soong | |
| 5,692,971 | A | 12/1997 | Williams | |
| 5,735,752 | A | 4/1998 | Antonious | |
| 5,904,627 | A | 5/1999 | Miyaji et al. | |
| 5,924,937 | A * | 7/1999 | Kuo | 473/296 |
| 6,045,457 | A | 4/2000 | Soong | |
| 6,056,646 | A | 5/2000 | Soong | |
| 6,056,648 | A | 5/2000 | Kusumoto et al. | |
| 6,113,508 | A | 9/2000 | Locarno et al. | |
| 6,155,932 | A | 12/2000 | Cabales et al. | |
| 6,224,596 | B1 * | 5/2001 | Jackson | 606/61 |
| 6,231,456 | B1 | 5/2001 | Rennie et al. | |
| 6,241,623 | B1 | 6/2001 | Laibangyang | |
| 6,257,997 | B1 | 7/2001 | Doble et al. | |
| 6,302,614 | B1 * | 10/2001 | Tseng | 403/109.5 |
| 6,308,590 | B1 | 10/2001 | Berto | |
| 6,349,451 | B1 | 2/2002 | Newman et al. | |
| 6,354,960 | B1 | 3/2002 | Perryman et al. | |

(Continued)

FOREIGN PATENT DOCUMENTS

JP 06-047115 A 2/1994

OTHER PUBLICATIONS

PCT Search Report dated May 28, 2008 for PCT App. Ser. No. PCT/US2008/051506.

*Primary Examiner*—Stephen L. Blau
(74) *Attorney, Agent, or Firm*—Henricks, Slavin & Holmes LLP

(57) ABSTRACT

An insert assembly for use with a golf club shaft including an insert and an insert lock.

21 Claims, 4 Drawing Sheets

U.S. PATENT DOCUMENTS

| | | | | |
|---|---|---|---|---|
| 6,361,451 | B1 | 3/2002 | Masters et al. | |
| 6,364,787 | B1 * | 4/2002 | Huiskamp | 473/294 |
| 6,364,789 | B1 * | 4/2002 | Kosmatka | 473/329 |
| 6,447,404 | B1 * | 9/2002 | Wilbur | 473/296 |
| 6,485,376 | B1 | 11/2002 | Hisamatsu | |
| D479,293 | S | 9/2003 | Bergling Olson | |
| 6,656,058 | B2 | 12/2003 | Thompson et al. | |
| 6,666,778 | B2 | 12/2003 | Ashida | |
| 6,755,752 | B2 | 6/2004 | Shimizu et al. | |
| 6,764,414 | B2 | 7/2004 | Kumamoto | |
| 6,773,358 | B1 | 8/2004 | Sumitomo et al. | |
| 6,797,208 | B2 | 9/2004 | Schikner | |
| 2001/0005696 | A1 * | 6/2001 | Hedrick | 473/318 |
| 2001/0007835 | A1 * | 7/2001 | Baron | 473/305 |
| 2002/0187850 | A1 * | 12/2002 | Kluck et al. | 473/318 |
| 2003/0027658 | A1 | 2/2003 | Li et al. | |
| 2005/0009620 | A1 | 1/2005 | Hodgetts | |
| 2005/0054459 | A1 * | 3/2005 | Oldenburg | 473/297 |
| 2005/0079925 | A1 | 4/2005 | Cheng et al. | |
| 2006/0183563 | A1 * | 8/2006 | Nemeckay | 473/239 |
| 2007/0111814 | A1 | 5/2007 | Cheng | |
| 2007/0111815 | A1 | 5/2007 | Cheng | |

* cited by examiner 200
212
204
202

200
212
218
214
216
226
220
224
204
222
208
210
202

114
112
110
208
202
200
100
108
204
116
106
206
102
202
104

112
108
110
102
100
116
106
104

GOLF CLUB SHAFT INSERT ASSEMBLY

BACKGROUND OF THE INVENTIONS

1. Field of the Inventions

The present inventions relate generally to golf clubs.

2. Description of the Related Art

Fiber reinforced resin shafts are commonly used in golf club drivers and irons. Such shafts, which are typically hollow and consist of a shaft wall formed around a tapered mandrel, may be produced with varying stiffness and bending profiles. As a result, golfers are able to choose shafts that are appropriate for their particular swing. If a shaft is too stiff for the golfer, then the shaft will not deflect sufficiently to generate a "kick" behind the golf ball. Conversely, if the shaft is not stiff enough, then the shaft will either lead or lag excessively, thereby causing the ball to leave the club head at a launch angle that is higher or lower than intended. Golfers typically make their shaft stiffness and bending profile determinations by trial and error.

In order to allow golfers to experiment with variations in staff stiffness and bending profile without purchasing a plurality of shafts, commonly owned U.S. Patent Pub. No. 2005/0079925 A1 proposes removable and interchangeable inserts that may be used to alter the stiffness and/or bending profile of a shaft. Although such inserts have proven to be quite helpful, the present inventor has determined that they are susceptible to improvement.

BRIEF DESCRIPTION OF THE DRAWINGS

Detailed description of embodiments of the inventions will be made with reference to the accompanying drawings.

DETAILED DESCRIPTION

The following is a detailed description of the best presently known modes of carrying out the inventions. This description is not to be taken in a limiting sense, but is made merely for the purpose of illustrating the general principles of the inventions. Additionally, although the present inventions are described in the context of fiber reinforced resin composite golf club shafts because the inventions are particularly well suited to such shafts, the inventions are not so limited and are applicable to a wide variety of golf club shafts, including those currently available and those yet to be developed.

Figures 1, 2, 3, 4:
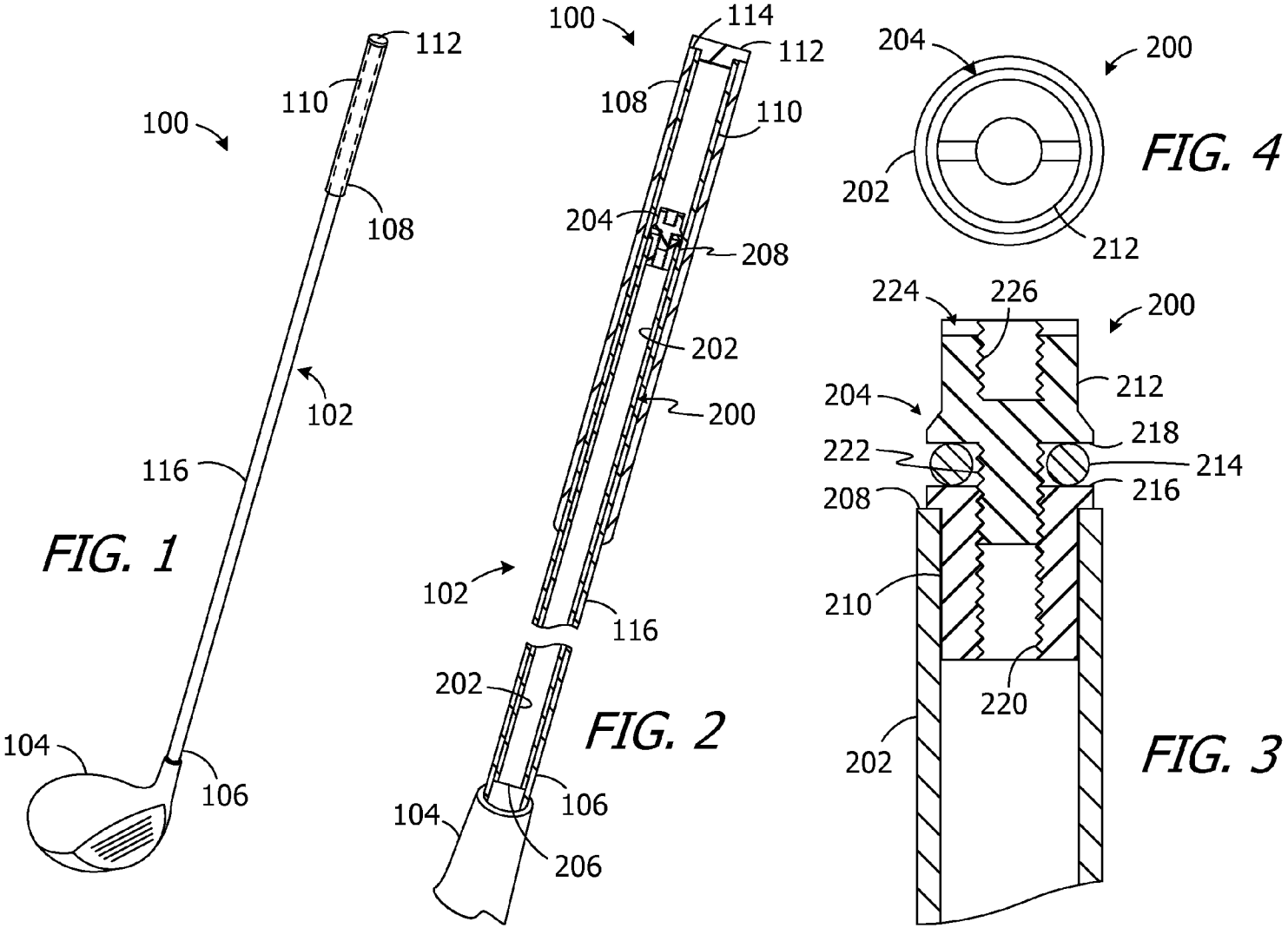
FIG. 1 is a side view of a golf club in accordance with one embodiment of a present invention.
FIG. 2 is a partial section view of the golf club illustrated in FIG. 1.
FIG. 3 is a section view of an insert assembly in accordance with one embodiment of a present invention.
FIG. 4 is a top view the insert assembly illustrated in FIG. 3.

The exemplary golf club 100 illustrated in FIGS. 1 and 2 includes a shaft 102 with a club head 104 on the tip section 106 and a grip 108 on the grip section 110. The exemplary shaft 102 is a tapered fiber reinforced resin composite shaft. An end cap 112 covers the shaft butt end 114. The section of the shaft 102 between the tip section 106 and the grip section 110 is referred to herein as the main section 116. The golf club 100 also includes one example of an insert assembly, which is generally represented by reference numeral 200, that may be removably secured within the shaft 102.

Although the present inventions are not limited to any particular golf club configurations, the exemplary golf club 100 is a "driver" and the club head 104 is a driver type club head. The present inventions are, however, equally applicable to any and all golf clubs including, but not limited to, all "woods," "irons," and "wedges." It should also be noted that the illustrated grip 108 and end cap 112 arrangement may be replaced by a continuous, integrally formed grip that covers both the shaft grip section 110 and butt end 114.

Turning to the insert assembly, the exemplary insert assembly 200 illustrated in FIG. 2 includes an insert 202 and an insert lock 204. The insert 202 alters the stiffness and/or bending profile of the shaft 102 and, typically, the golfer will experiment with a number of insert assemblies of varying length, stiffness and bending profile. The insert lock 204 frictionally engages the inner surface of the associated shaft 102 to hold the insert 202 in place. As a result, the insert lock 204 facilitates the use of inserts that do not extend to the butt end 114 of the associated shaft 102 where, as disclosed in U.S. Patent Pub. No. 2005/0079925 A1, the end cap 112 would prevent longitudinal movement of inserts without insert locks that extended to the butt end. The use of inserts that do not extend to the butt end of the associated shaft provides golfers with additional choices while attempting to determine the optimal stiffness and bending profile.

The insert 202 in the exemplary insert assembly 200 illustrated in FIG. 2 is configured to fit into the associated golf club shaft 102. More specifically, the outer perimeter of the insert 202 and the inner perimeter of the shaft 102 are extremely close in shape and dimension. For example, if the shaft 102 is a tapered shaft, the insert 202 will typically have the same taper and the tip end 206 of the insert will have an outer diameter that is substantially the same as the inner diameter of the portion of the shaft where the tip end 206 is to be located. The insert tip end 206 will, of course, be prevented from moving beyond this point because the inner diameter of the tapered shaft 102 beyond this point will be smaller than the outer diameter of the insert tip end. As illustrated for example in FIG. 2, the outer diameter of the insert 202 will also be substantially the same as the inner diameter of the shaft from insert tip end 206 to the insert butt end 208. This causes a frictional engagement (or "press fit") between the shaft 102 and the insert 202. With respect to wall thickness (i.e. the difference between the inner diameter and the outer diameter), the insert 202 may have a constant wall thickness or one that varies.

In those instances where the golf club shaft is not tapered from tip end to butt end, e.g. in those instances where the shaft has a tapered main section and cylindrical tip and grip sections, the insert may be shaped accordingly. For example, the insert may be tapered over its entire length and dimensioned so as to reside only in the shaft main section, or the insert may be tapered over the substantial majority of its length and have a short cylindrical grip section that is coextensive with a small portion of the grip section of the shaft.

With respect to materials, the insert 202 is preferably formed from relatively light weight materials such as graphite or a polymer. A typical weight is about 15 grams or less. Different portions of the insert (e.g. the top half and the bottom half) may also be made from different materials if desired. The length of the insert 202 will typically be about 20 to 30 inches, but this may be varied as desired. The outer diameter may, depending on the length of the insert and the size of the associated golf club shaft, range from about 5 mm to 11 mm at the tip end to about 8 mm to 14 mm at the butt end. The inserts may be manufactured to the desired lengths or manufactured to set lengths and then cut as necessary. Dimensional marking may be provided to facilitate accurate cuts. Suitable graphite insert manufacturing techniques include sheet-wrapping, filament-winding, and internal bladder molding, among other appropriate techniques. For example, one or more layers of Toray graphite material (e.g. Toray T700, M30, M40J, M46J or M50J) may be sheet-wrapped around a layer of light weight (e.g. about 100 g/m$^2$ or less) scrim or a layer of graphite pre-preg. Suitable polymer manufacturing techniques include injection molding.

The outer surface of the insert 202 may, in some instances, be coated with a coating that improves the fit between the insert and the golf club shaft 102 and reduces noise that may result from the engagement of the insert and the shaft. One example of such a coating is a soft polyurethane based coating. Additional details concerning inserts is provided in U.S. Patent Pub. No. 2005/0079925 A1, which is incorporated herein by reference.

Turning to FIGS. 3 and 4, the insert lock 204 in the exemplary insert assembly 200 includes a base 210 that is positioned within the insert 202 at the butt end 208, a cap 212 that is longitudinally movable relative to the base, and a resilient member 214 between the base and the cap. Compression of the resilient member 214, due to a reduction in the space between the base compression surface 216 and the cap compression surface 218, causes the resilient member to expand radially and frictionally engage the inner surface of the associated golf club shaft. The frictional engagement between the resilient member 214 and the inner surface of the golf club shaft 102 prevents the insert assembly 200 from moving relative to the shaft, i.e. locks the insert assembly in place, as is explained below with reference to FIGS. 5 and 6.

The base 210 in the illustrated embodiment is permanently secured to the insert 202. As used herein, the phrase "permanently secured" means that the base cannot be removed from the insert 202 by hand without excessive effort. For example, the base 210 may be permanently secured to the insert 202 with a high strength adhesive from the class of adhesives commonly referred to as "structural adhesives" or "engineering adhesives." Such adhesives include epoxy, polyurethane, acrylic, cyanoacrylate adhesives. A permanently secured base 210 could also be an integral part of the insert 202 in those instances where the insert and base are molded as a single unit. In other embodiments, the base 210 may simply be removably inserted into the butt end 208 so that, for example, a single insert lock 204 may be used with a plurality of different inserts 202. Here, however, the insert 202 and base 210 should be mechanically keyed in order to prevent rotation of the base relative to the insert during the locking and unlocking operations described below with reference to FIGS. 5-9.

Longitudinal movement of the cap 212 relative to the base 210 is facilitated in the exemplary insert lock 204 by threaded connectors on the cap and base. In the illustrated embodiment, the threaded connectors are in the form of a threaded base lumen 220 and a complimentarily threaded cap post 222. This arrangement may be reversed, such that the cap includes a threaded lumen and the base includes a threaded post. Because the base 210 is rotationally fixed, by virtue of its connection to the insert 202 and the press fit between the insert and inner surface of the golf club shaft 102, the cap 212 will move longitudinally towards the base as it rotates in one direction relative to the base ("the locking direction") and will move longitudinally away from the base as it rotates in the opposite direction ("the unlocking direction"). To that end, the cap 212 is provided with a slot 224 that is used to rotate the cap in the locking direction and a threaded lumen 226 that is used to rotate the cap in the unlocking direction in the manner discussed below.

Figure 5:
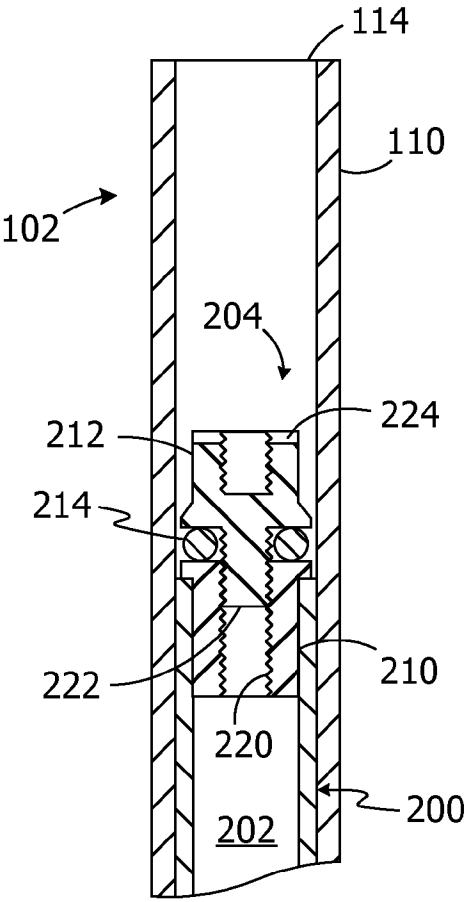
FIG. 5 is a section view showing the insert assembly illustrated in FIGS. 3 and 4 in an unlocked state within a golf club shaft.

The exemplary insert lock 204 is shown in the unlocked state in FIG. 5. The distance between the base compression surface 216 and the cap compression surface 218 is such that resilient member 214 is not compressed. The configuration of the resilient member 214 is such that when it is not compressed, there will either be a small gap between the resilient member and the inner surface of the shaft 102, or the resilient member will not engage the inner surface of the shaft with enough force to prevent movement of the insert assembly 200. In the exemplary embodiment, there is a gap between the resilient member 214 and the inner surface of the shaft 102 when the insert lock is in the unlocked state.

Figure 6:
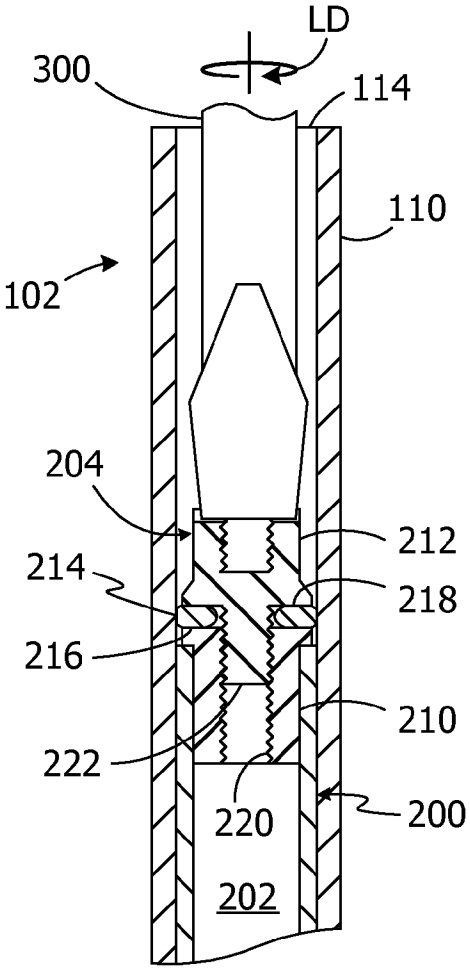
FIG. 6 is a partial section view showing the insert assembly illustrated in FIGS. 3 and 4 in a locked state within a golf club shaft.

Turning to FIG. 6, a flat-head extended screwdriver 300 is one example of a tool that may be inserted into the slot 224 and used to rotate the cap 212 in the locking direction, which is represented by arrow LD. Such rotation causes the cap 212 to move longitudinally towards the base 210 and, as noted above, causes the compression of the resilient member 214 between the compression surfaces 216 and 218. The insert lock 204 is considered to be locked when the compression of the resilient member 214 reaches the point at which the associated radial expansion results in enough friction force to prevent the insert assembly 202 from moving relative to the shaft 102, as it is in FIG. 6.

It should be noted that here that the slot 224 may be reconfigured to receive other tools that can rotate the cap 212. For example, the slot 224 may be reconfigured to receive a phillips-head screw driver.

The exemplary removal tool 400 illustrated in FIGS. 7-10 may be used to unlock the insert lock 204 and remove the insert assembly 200 from the shaft 102. The removal tool 400 includes an elongate shaft 402 with a handle 404 at one end and a threaded connector at the other that is configured to mate with a correspondingly threaded connector on the cap. In the illustrated embodiment, the removal tool 400 includes threaded post 406 that is configured to mate with the threaded lumen 226 in the cap 212. It should be noted here that this arrangement may be reversed, such that the cap includes a threaded post and the tool includes a threaded lumen. In either case, the threads associated with locking the insert lock 204 and the threads associated with unlocking the insert lock will preferably be oriented in opposite directions. The threads of the base lumen 220 and cap post 222 in the illustrated embodiment are, for example, right handed threads while the threads of the lumen 226 and post 406 are left handed. The thread orientations may also be reversed.

Figure 9:
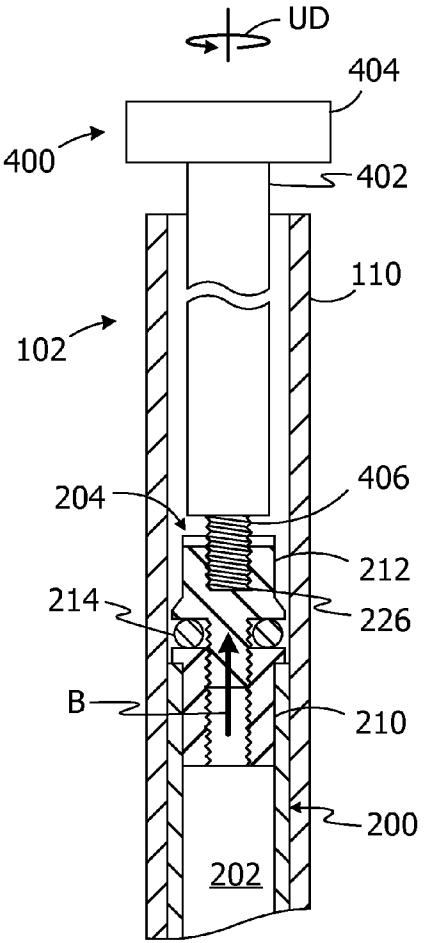
FIGS. 7-9 are partial section views showing the insert assembly illustrated in FIGS. 3 and 4 being returned to the unlocked state.
Figure 8:
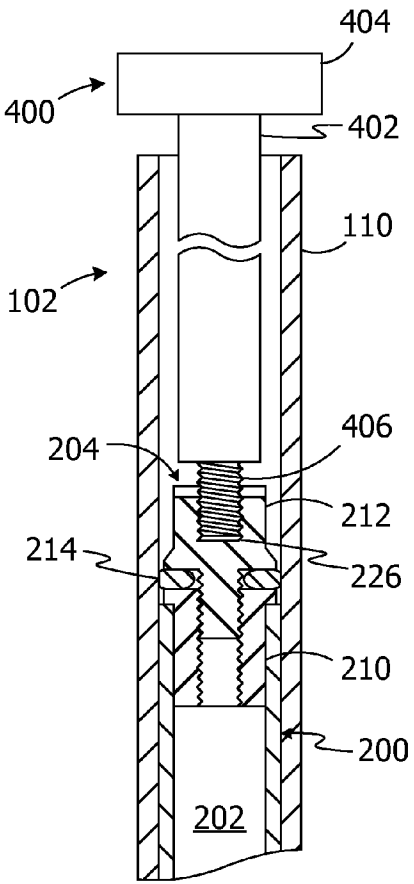
Figure 7:
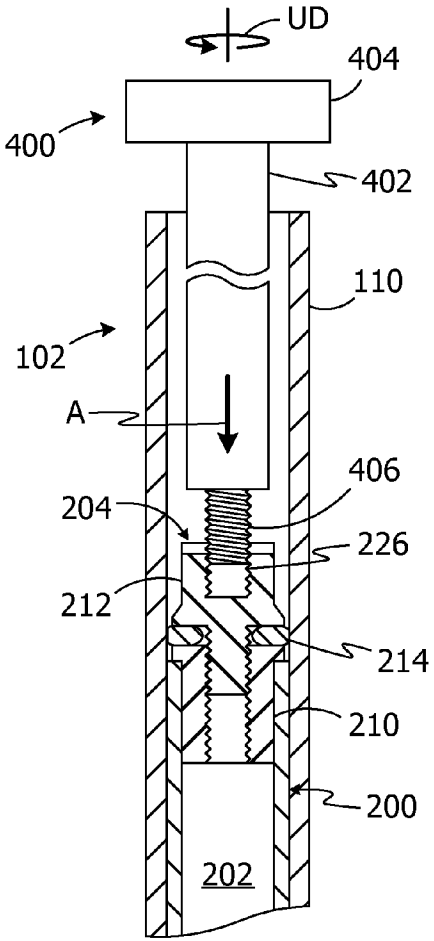

With respect unlocking, the removal tool 400 may be used to unlock the insert lock 204 in the manner illustrated in FIGS. 7-9. Referring first to FIG. 7, the removal tool 400 may be inserted into the golf club shaft 102 and moved longitudinally in the direction of arrow A. Once the threaded post 406 reaches the threaded cap lumen 226, the removal tool 400 is rotated in the unlocking direction, which is represented by arrow UD, relative to the cap 212. The cap 212 will not rotate at this point. Continued rotation of the removal tool 400 relative to the cap 212 causes the post 406 to move longitudinally into the cap lumen 226 until it reaches the closed end of the cap lumen, as is shown FIG. 8. At this point, the removal tool 400 will no longer be able to rotate in the unlocking direction UD relative to the cap 212. Thus, subsequent rotation of the removal tool 400 in the unlocking direction UD will result in rotation of the cap 212 in the unlocking direction. Such rotation will, due to threaded base lumen 220 and threaded cap post 222, cause the cap 212 to move longitudinally away from the base 210, as is shown by arrow B in FIG. 9. This allows the resilient member 214 to return to the uncompressed state. The return of the resilient member 214 to the uncompressed state illustrated in FIG. 9 also marks the return of the insert lock 204 to the unlocked state.

Figure 10:
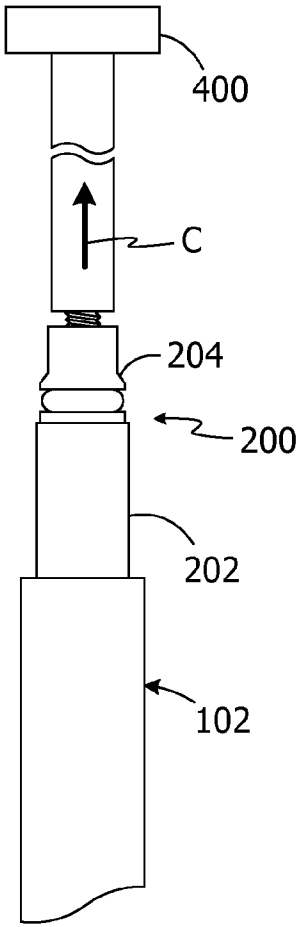
FIG. 10 is a side view showing the insert assembly illustrated in FIGS. 3 and 4 being removed from a golf club shaft.

Turning to removal of the insert assembly 200 from the shaft 102, the removal tool 400 will remain connected to the cap 212 when the insert lock 204 returns to the unlocked state illustrated in FIG. 9. As such, and as illustrated in FIG. 10, the removal tool 400 may be used to pull the insert assembly 200 in the direction indicated by arrow C and, ultimately, out of the shaft 102.

With respect to materials for the insert lock 204 components, the base 210 and cap 212 may be formed from strong, lightweight materials such as hard plastic or aluminum. The resilient member 214 may be formed from rubber and/or other suitable resilient materials. The removal tool 400 may be formed from metal or hard plastic. The shape of the resilient member may be a torus (as shown), a toroid, an annular disc, or any other suitable shape.

Figure 11:
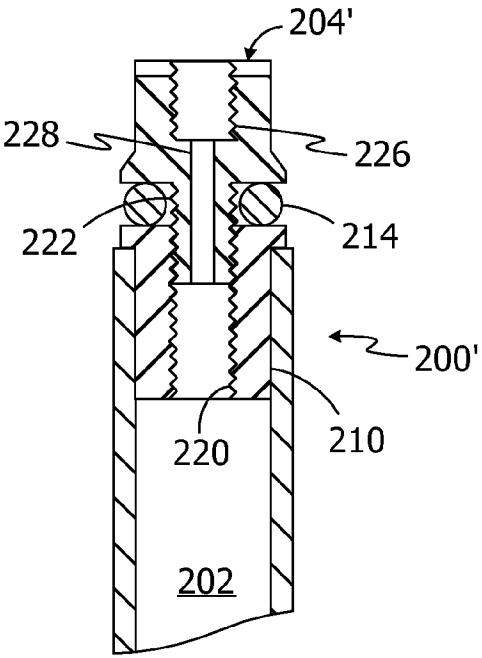
FIG. 11 is a section view of an insert assembly in accordance with one embodiment of a present invention.

The present inventions also include insert assemblies that allow for the movement of air as the insert assembly is placed into the shaft, locked, unlocked, and removed from the shaft. As illustrated for example in FIG. 11, this may be accomplished by providing an insert assembly 200' with an air passage 228 that extends through the cap post 222 in the insert lock 204', thereby connecting the base member lumen 220 to the cap lumen 226. The remainder of the insert assembly 200' is identical to the insert assembly 200 and the structural elements are represented by the same reference numerals.

Although the present inventions have been described in terms of the preferred embodiments above, numerous modifications and/or additions to the above-described preferred embodiments would be readily apparent to one skilled in the art. By way of example, but not limitation, the present inventions include golf club shafts and golf clubs (e.g. a shaft and a club head) in combination with the insert assemblies described above and defined by the claims below. The golf clubs may also include a grip and an end cap. The present inventions also include insert assembly sets having multiple insert assemblies, as described above and defined by the claims below, with inserts of different length, stiffness and/or bending moment. Each insert assembly in the set may include a permanently secured insert lock, or a single, separable insert lock may be provided. The present inventions also include kits consisting of a removal tool and one or more of the insert assemblies described above and defined by the claims below. The present inventions also include the insertion, locking, unlocking and removal methods described above. It is intended that the scope of the present inventions extend to all such modifications and/or additions.

I claim:

1. An insert assembly for use with a golf club shaft having an inner surface, a shaft butt end defining an outer diameter and a shaft tip end defining an inner diameter and an outer diameter that is less than the shaft butt end outer diameter, the insert assembly comprising:

a tapered shaft insert including a tapered outer surface, an insert butt end defining an outer diameter and an insert tip end defining an outer diameter that is less than the insert butt end outer diameter and is greater than the shaft tip end inner diameter; and an insert lock, including a base with a threaded lumen that is permanently secured to the tapered shaft insert, associated with the tapered shaft insert butt end and configured to be removably secured to the inner surface of the golf club shaft while the tapered outer surface engages the inner surface of the of the golf club shaft.

2. An insert assembly as claimed in claim 1, wherein the tapered shaft insert comprises a graphite tapered shaft insert.

3. An insert assembly as claimed in claim 2, wherein the tapered outer surface of the graphite tapered insert includes a soft coating.

4. An insert assembly as claimed in claim 3, wherein the soft coating comprises a soft polyurethane based coating.

5. An insert assembly as claimed in claim 1, wherein the insert lock is permanently secured to the insert butt end.

6. An insert assembly as claimed in claim 1, wherein the insert lock includes an expandable member.

7. An insert assembly as claimed in claim 1, wherein the threaded lumen comprises a longitudinally threaded lumen.

8. An insert assembly as claimed in claim 1, wherein the tapered insert defines a length and is tapered over its entire length.

9. An insert assembly for use with a golf club shaft having an inner surface, the insert assembly comprising:

a tapered shaft insert defining a butt end; and an insert lock associated with the tapered shaft insert and configured to be removably secured to the inner surface of the golf club shaft, the insert lock including a base carried by the butt end of the tapered shaft insert, a cap that is longitudinally movable relative to the base and defines a butt end which faces away from the base and in the same direction as the butt end of the tapered shaft insert and includes a butt end connector that is configured to mate with a tool in response to rotation of the tool and a butt end slot, and a resilient member between a portion of the base and a portion of the cap.

10. An insert assembly as claimed in claim 9, wherein the cap is operably connected to the base such that rotation of the cap relative to the base results in longitudinal movement of the cap relative to the base.

11. An insert assembly as claimed in claim 9, wherein the tapered shaft insert comprises a graphite tapered shaft insert.

12. An insert assembly as claimed in claim 9, wherein the insert lock is permanently secured to the tapered shaft insert.

13. An insert assembly as claimed in claim 9, wherein the tapered insert defines a length and is tapered over its entire length.

14. An insert assembly as claimed in claim 9, wherein the resilient member defines a shape selected from the group comprising a torus, a toroid, and an annular disk.

15. An insert assembly as claimed in claim 9, wherein the resilient member and the base are not integral with one another.

16. An insert assembly for use with a golf club shaft having an inner surface, the insert assembly comprising:

a tapered shaft insert defining a butt end; and an insert lock associated with the tapered shaft insert and configured to be removably secured to the inner surface of the golf club shaft, the insert lock including a base carried by the butt end of the tapered shaft insert, a cap that is operably connected to the base such that rotation of the cap relative to the base results in longitudinal movement of the cap relative to the base and defines a butt end which faces away from the base and in the same direction as the butt end of the tapered shaft insert and includes a butt end connector and a butt end slot, and a resilient member between a portion of the base and a portion of the cap;

wherein the cap includes a threaded cap connector and the base includes a correspondingly threaded base connector.

17. An insert assembly for use with a golf club shaft having an inner surface, the insert assembly comprising:

a shaft insert; and an insert lock, associated with the shaft insert and configured to be removably secured to the inner surface of the golf club shaft, including a base with a threaded base connector, a cap with a first threaded cap connector, which is configured to mate with the threaded base connector such that rotation of the cap relative to the base results in longitudinal movement of the cap relative to the base, and a second threaded cap connector, the threads of the first threaded cap connector being oriented in a different direction than the threads of the second threaded cap connector, and a resilient member between a portion of the base and a portion of the cap.

18. An insert assembly as claimed in claim 17, wherein the shaft insert comprises a graphite shaft insert.

19. An insert assembly as claimed in claim 17, wherein the insert lock is permanently secured to the shaft insert.

20. An insert assembly for use with a golf club shaft having an inner surface, the insert assembly comprising:

a graphite shaft insert including a soft polyurethane based coating; and an insert lock, associated with the graphite shaft insert and configured to be removably secured to the inner surface of the golf club shaft, including a base, a cap, which is longitudinally movable relative to the base, defining a butt end that faces away from the base and includes a threaded butt end connector and a butt end slot, and a resilient member between a portion of the base and a portion of the cap.

21. An insert assembly as claimed in claim 20, wherein the insert lock is permanently secured to the shaft insert.

* * * * *